US006601503B2

(12) United States Patent
Scholzig et al.

(10) Patent No.: US 6,601,503 B2
(45) Date of Patent: Aug. 5, 2003

(54) METHOD AND DEVICE FOR COUPLING IN/OUT A CYLINDER IN A PRINTING MACHINE

(75) Inventors: Jurgen Scholzig, Mainz-Finthen (DE); Reinhold Guba, Weiterstadt (DE)

(73) Assignee: MAN Roland Druckmaschinen AG (DE)

( * ) Notice: Subject to any disclaimer, the term of this patent is extended or adjusted under 35 U.S.C. 154(b) by 0 days.

(21) Appl. No.: 10/168,994

(22) PCT Filed: Dec. 13, 2000

(86) PCT No.: PCT/EP00/12636

§ 371 (c)(1),
(2), (4) Date: Sep. 18, 2002

(87) PCT Pub. No.: WO01/45944

PCT Pub. Date: Jun. 28, 2001

(65) Prior Publication Data

US 2003/0097942 A1 May 29, 2003

(30) Foreign Application Priority Data

Dec. 22, 1999 (DE) ..... 199 62 421

(51) Int. Cl.[7] ..... B41F 5/16

(52) U.S. Cl. ..... 101/184; 101/181; 101/182; 101/183; 101/212; 101/216; 29/898.07; 29/898.08; 384/256

(58) Field of Search ..... 101/216, 212, 101/219, 181–184; 29/898.07, 898.08; 384/256, 257, 273, 416

(56) References Cited

U.S. PATENT DOCUMENTS

| | | | | | |
|---|---|---|---|---|---|
| 3,147,702 | A | | 9/1964 | Martin | |
| 4,716,827 | A | * | 1/1988 | Wieland et al. | 101/216 |
| 4,735,140 | A | * | 4/1988 | Wieland et al. | 101/230 |
| 5,647,275 | A | * | 7/1997 | Lupa et al. | 101/216 |
| 5,701,818 | A | * | 12/1997 | Mohrmann | 101/375 |
| 5,894,796 | A | * | 4/1999 | Gelinas | 101/219 |

FOREIGN PATENT DOCUMENTS

| | | |
|---|---|---|
| DE | 296 17 401 U1 | 1/1997 |
| DE | 195 37 421 C1 | 3/1997 |
| EP | 0 714 767 A1 | 6/1996 |
| EP | 0 894 623 A2 | 2/1999 |

OTHER PUBLICATIONS

Patent Abstracts of Japan, vol. 013, No. 090 (M–803), Mar. 2, 1989 & JP 63 281883 A (Komori Printing Mach Co Ltd), Nov. 18, 1988 Zusammenfassung.

* cited by examiner

*Primary Examiner*—Andrew H. Hirshfeld
*Assistant Examiner*—Andrea A. Hence
(74) *Attorney, Agent, or Firm*—Leydig, Voit & Mayer, Ltd.

(57) ABSTRACT

A method and apparatus for more simply and efficiently coupling and decoupling a cylinder in a printing machine. The coupling and decoupling apparatus includes a bearing bushing (11) in a fixed bushing (28). The bearing bushing (11) carries an axial force loaded spindle (10) that is axially displaceable within the bushing (11) between a coupling position in a centering portion (9) of the cylinder and a decoupling position in which a braking system (24, 25) is engaged.

10 Claims, 6 Drawing Sheets

METHOD AND DEVICE FOR COUPLING IN/OUT A CYLINDER IN A PRINTING MACHINE

FIELD OF THE INVENTION

The invention relates to a method and device for coupling and uncoupling cylinders in a printing press.

BACKGROUND OF THE INVENTION

DE 195 37 421 C1 discloses a method and apparatus for disconnecting a cylinder from a drive which includes a coupling consisting of first and second clutch disks. The first clutch disk is connected without rotational play to a drive wheel and the second clutch disk is connected without rotational play to the cylinder journal. Both clutch disks can be axially shifted with respect to each other by means of a work cylinder to which pressure can be applied. In the process, a lower pressure is applied to the work cylinder during the coupling process than the final pressure which is applied in the coupled state. The first clutch disk is connected with a control valve whereby the control valve can be actuated by the second clutch disk in such a way that during the coupling of the work cylinder, the control valve contains a pressure medium and the control valve is closed in the coupled state.

EP 0 714 767 A1 discloses a device for coupling a rotatary cylinder in a printing machine where a drive wheel is fixed during the removal of the cylinder. The cylinder journal of the rotatary cylinder is arranged in the frame, formed by two half-shells, in an openable bearing. The bearing is provided with a bore in a bearing bushing, where the bore is concentric with the cylinder axis. A hollow shaft rotates in the bore without play, and a control shaft that can be axially displaced is arranged in said hollow shaft where each control shaft and the associated cylinder journal are connected by means of coupling halves. On the end, the drive wheel is attached to the hollow shaft, and between the hollow shaft and the control shaft, an additional gear is arranged, with clearance, which compensates for shaft misalignment. The hollow shaft has internal teeth, and the control shaft has two external sets of teeth that cooperate with the internal teeth, and can be rotated with respect to each other.

DE 296 17 401 U1 discloses a device for the connection/disconnection of roller elements of a printing machine. By the axial shifting of a journal, using a tensioning spindle which passes through the roller body, the coupling of the roller and bearing is achieved. On one side, the tensioning spindle can be screwed into the first journal, and, one the other side, a tensioning screw passes through a second journal and can be screwed into the tension spindle. The roller body presents, on the front side, passage bores for receiving the journal where compression springs are arranged in the passage bores can be connected to the roller body by the actuation of the tensioning screws of both journals against the spring force. A drawback of this arrangement is that all of the embodiments are relatively expensive.

OBJECTS AND SUMMARY OF THE INVENTION

It is an object of the present invention to provide a method and apparatus which avoids the drawbacks of the prior art and which enables efficient coupling and uncoupling of cylinders and bearings, while simplifying the drive and reducing equipment installation times.

A first advantage of the method and apparatus of the invention is that the coupling process can be automated. As a result, a considerable reduction of installation time can be achieved in the replacement of a cylinder in a printing machine.

Another advantage is that the coupling and decoupling of the cylinder can be carried out rapidly and reliably and that a high rotational precision can be achieved by centering the cylinder.

An additional advantage is that the cylinder can be designed with or without a journal. A recess for the journals which penetrates the lateral frame is not necessary.

This simplifies the insertion or the replacement of the cylinder between two lateral frame walls, regardless of whether the operations are carried out manually or in automated fashion, for example, by means of a magazine and/or handling device, or industrial robots.

Finally, it is advantageous that a replacement of the cylinder, or alternately, of a roller, can be carried out in a manual or automated process. For example, in printing and/or coating machines, an automated replacement of the printing/coating block can be carried out, while an automated replacement of cylinders or rollers in the bearing bushings is carried out, preferably simultaneously.

Other objects and advantages of the invention will become apparent upon reading the following detailed description and upon reference to the drawings, in which:

Figure 1:
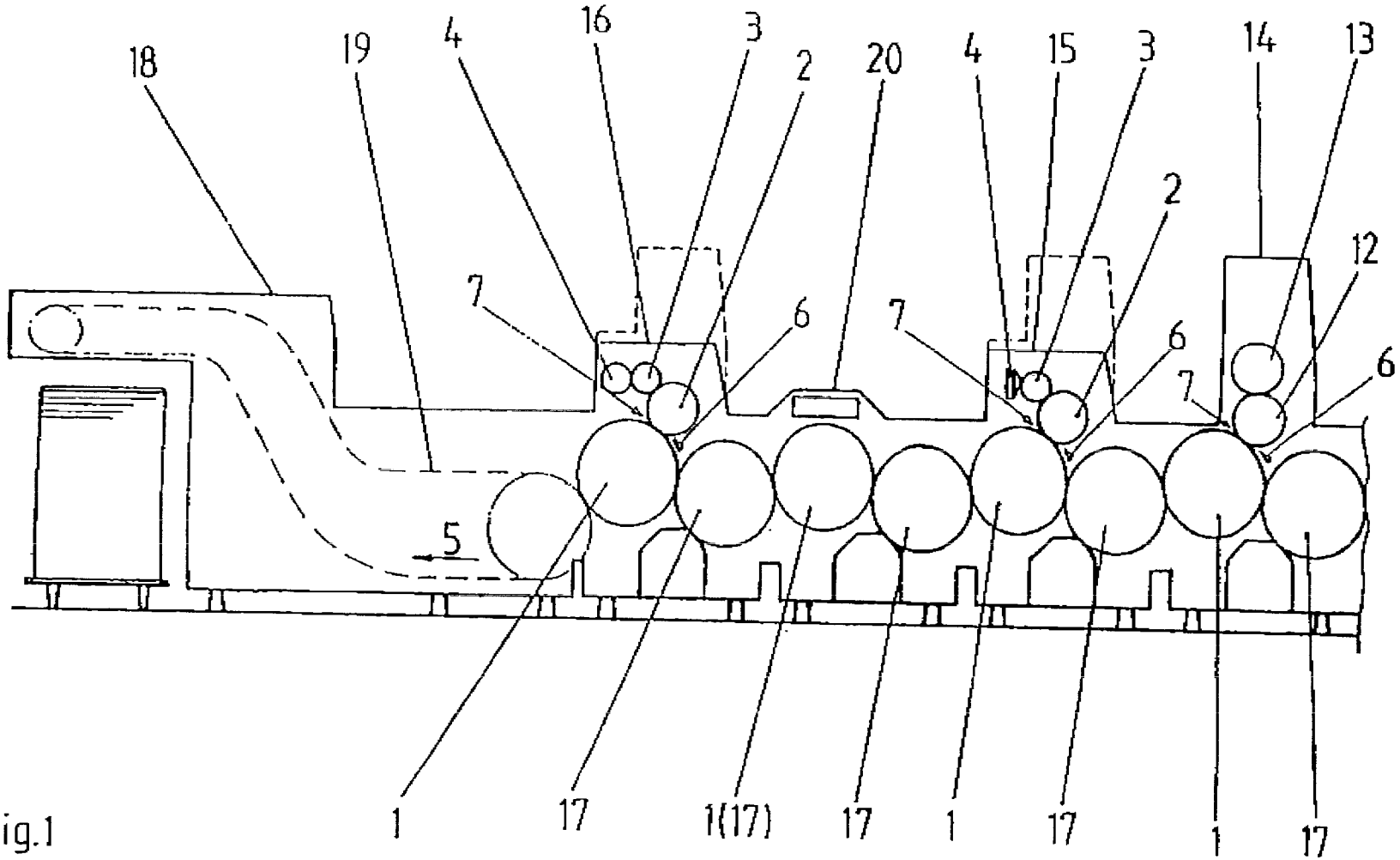
FIG. 1 is a partially diagrammatic side elevational view of an illustrative sheet fed fed rotary printing machine having two coating machines with cylinders with decoupling devices in accordance with the invention.

While the invention is susceptible of various modifications and alternative constructions, certain illustrative embodiments thereof have been shown in the drawings and will be described below in detail. It should be understood, however, that there is no intention to limit the invention to the specific forms disclosed, but on the contrary, the intention is to cover all modifications, alternative constructions, and equivalents falling within the spirit and scope of the invention.

DETAILED DESCRIPTION OF THE PREFERRED EMBODIMENTS

Referring now more particularly to the drawings, there is shown an illustrative sheet-fed printing machine which in this case includes several printing units 14 for multi-color printing, and two coating units 15, 16 which are connected downstream in the sheet travel direction 5.

A sheet-fed rotary printing machine may consist of, for example, several printing units 14 for multicolor printing, and two coating units 15, 16, which are connected downstage relative to the machine direction 5. A drying system 20 is arranged between the two coating units 15, 16. The last coating unit 16 is followed by a sheet delivery unit 18, which has a circulating conveyance system 19 for transporting and depositing the sheet material on a sheet delivery stack.

Each printing unit 14 includes a plate cylinder 13 of single size, a rubber sheet cylinder 12 of single size, and a double size printing cylinder 1 as a sheet guide cylinder. The plate unit 13 is associated with an inking device and optionally a damping device. Each coating unit 15, 16 includes a form cylinder 2 of single size, and an associated cylinder 3 as ink application roller and a metering system, and it is functionally connected with a double size printing cylinder 1 as a sheet guide cylinder.

Between the printing units 14, the first coating unit 15, the drying system 20 and the second coating unit 16, transfer cylinders 17 of double size are arranged as sheet guide cylinders. Here a printing cylinder 1 or a transfer cylinder 17, as desired, as sheet guide cylinder 2, is associated with the drying system 20. In the area of the printing zones of the rubber sheet cylinder 12 and the printing cylinder 1, as well as of the form cylinder 2 and the printing cylinder 1, sheet guide devices 6, 7 which can be actuated pneumatically, are arranged before and after each printing zone, in the show flow or machine direction 5. In the first coating unit 15, the metering system 4 is formed by a chamber scraper 4 with a feed system and a return system for a liquid medium. The cylinder 3 is designed as a grid-like application roller 3 in the present example. In the second coating unit 16, the metering system 3, 4 is formed by two cylinders, in this instance, an application roller 3 and a metering roller 4.

Figure 2:
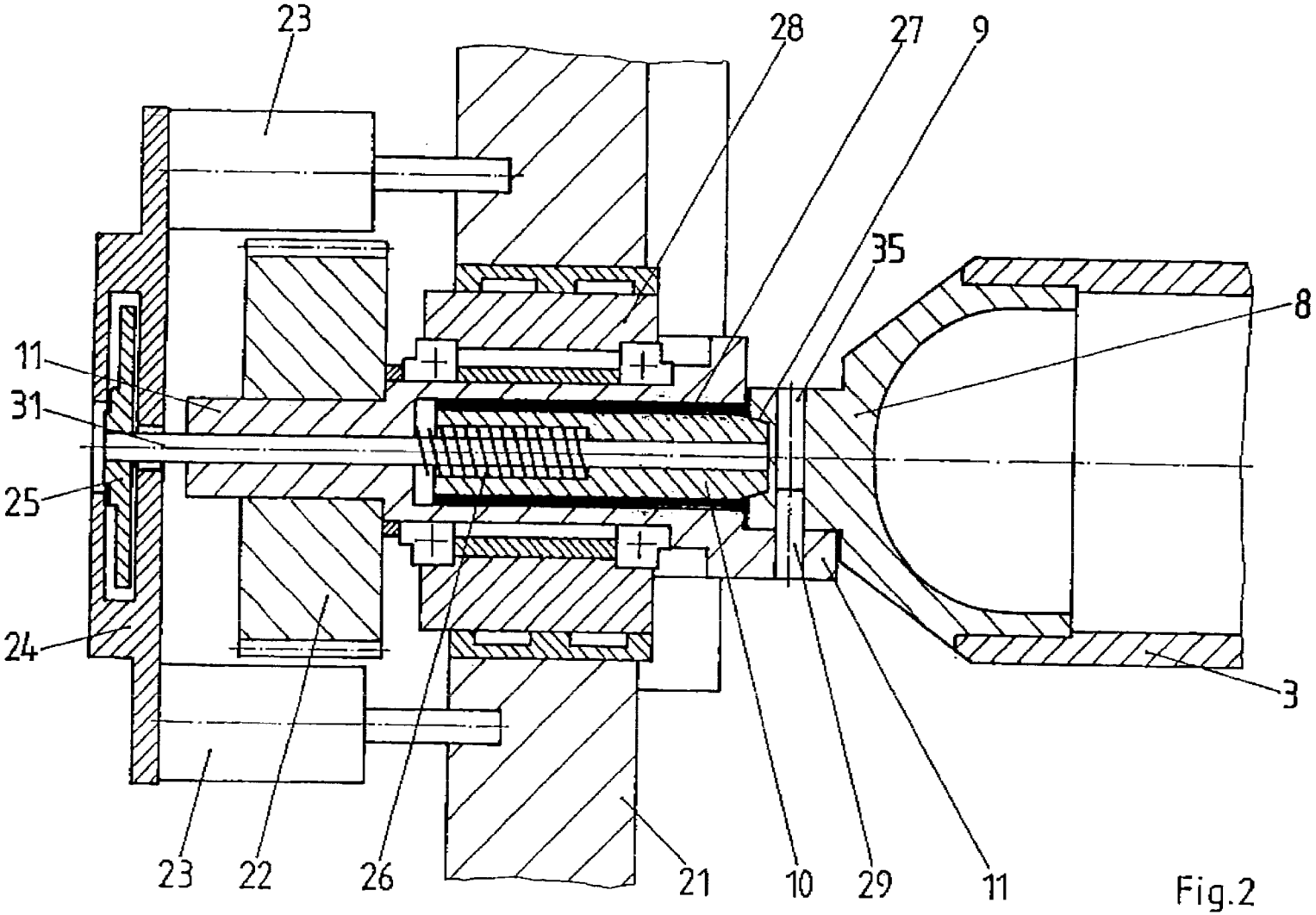
FIG. 2 is an enlarged vertical section of a bearing of one of the cylinders on a drive side (side A)

In keeping with the invention, the illustrated roller or cylinder 3 has a centering device 9 on both ends 8. In particular, the centering device 9 is designed in the form of a cylinder or cone. Both centering devices 9 are arranged with mirror symmetry with respect to each other so that they are aligned on the cylinder axis. As shown in FIG. 2, in the lateral machine frame 21 on one side, for example, the drive side (A side), a bearing 28 is provided, preferably a commercially available eccentric bearing. A bearing bushing 11 is arranged in the bearing 28, which, at one end, receives the end 8 of the cylinder 3, and to which, at the other end, a fixed drive 22, preferably a gear wheel is attached which can be driven. A rod 31 is arranged in the bearing bushing 11, which is aligned with the axis of the cylinder 3 and passes through the center of the bearing bushing 11. The end of rod 31 carries, in the direction toward the end 8, a concentrically arranged spindle sleeve 10 and, on the other end, a brake disk 25. The spindle sleeve 10 is arranged inside the bearing bushing 11 in a linear guide 27, preferably without clearance. In the direction toward the end 8, the spindle sleeve 10, at least in the region of the end of the spindle sleeve, is designed in the form of a cylinder, cone or truncated cone, which cooperates with a centering portion 9 of the cylinder 3. It is preferred that the surface (at the least the tip surface) of the spindle sleeve 10 have a slightly cambered form to compensate for slight alignment errors and to support the centering of the cylinder 3.

Inside the bearing bushing 11, between the bushing 11 and the spindle sleeve 10, a tensioning system 26 is arranged, for example, a spring system, preferably concentrically with respect to the rod 31. The brake disk 25, which is arranged on the end of the rod 31, is a part of the brake system, which also includes a holder plate 24 and at least one, preferably several, actuation devices 23, preferably a working cylinder that can be actuated pneumatically. Alternately, working cylinders that can be actuated hydraulically could be used.

The holder plate 24 fulfills two functions. On the one hand, it functions as a brake shoe for the brake disk 25; on the other hand, it supports actuation devices 23 which are supported on the lateral frame 21. If the bearing 28 is in the form of an eccentric bearing, then the actuation devices 23 are supported on the bearing 28 to guarantee the pivoting motion of the eccentric bearing. In a preferred embodiment according to FIG. 2, the bearing bushing 11 is designed as a half-shell bearing open on one side. The bearing bushing 1, in this case in the form of a half-shell bearing, receives the end 8 of the cylinder 3 and includes a locking mechanism 29 adapted to engage the cylinder 3.

Figure 3:
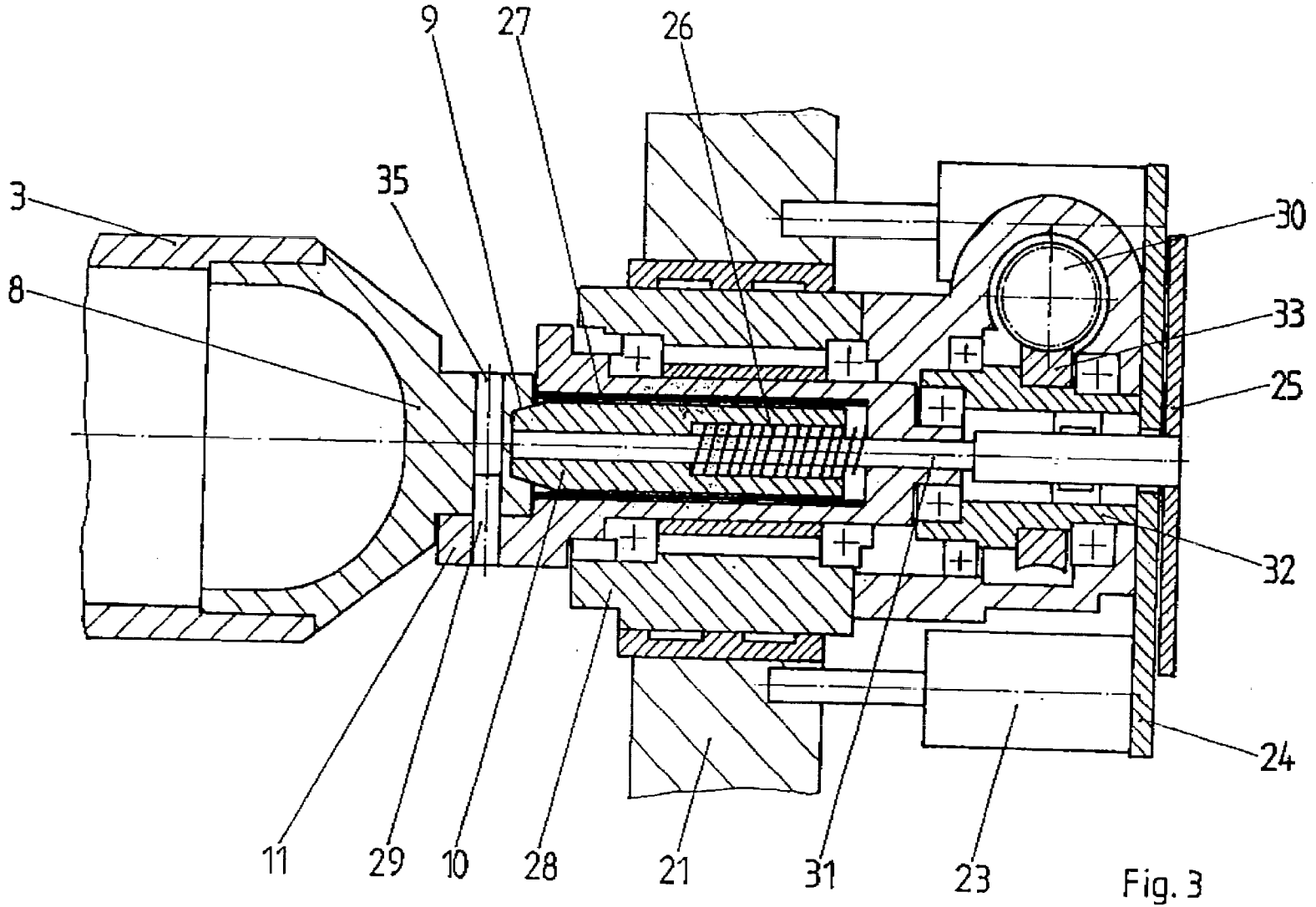
FIG. 3 is a vertical section of a bearing of a cylinder on a drive side (side B) of the machine.

In one embodiment, the locking mechanism 29, for example, in the form of a bolt, or a bolt with spherical head, or a sphere, is arranged radially with respect to the axis of the cylinder 3 on the bearing bushing 11 (in the area of the half-shell bearing), and it is form fit to the opening or bore 35 arranged radially on the end 8 to form a positive connection (FIGS. 2, 3).

Figure 4:
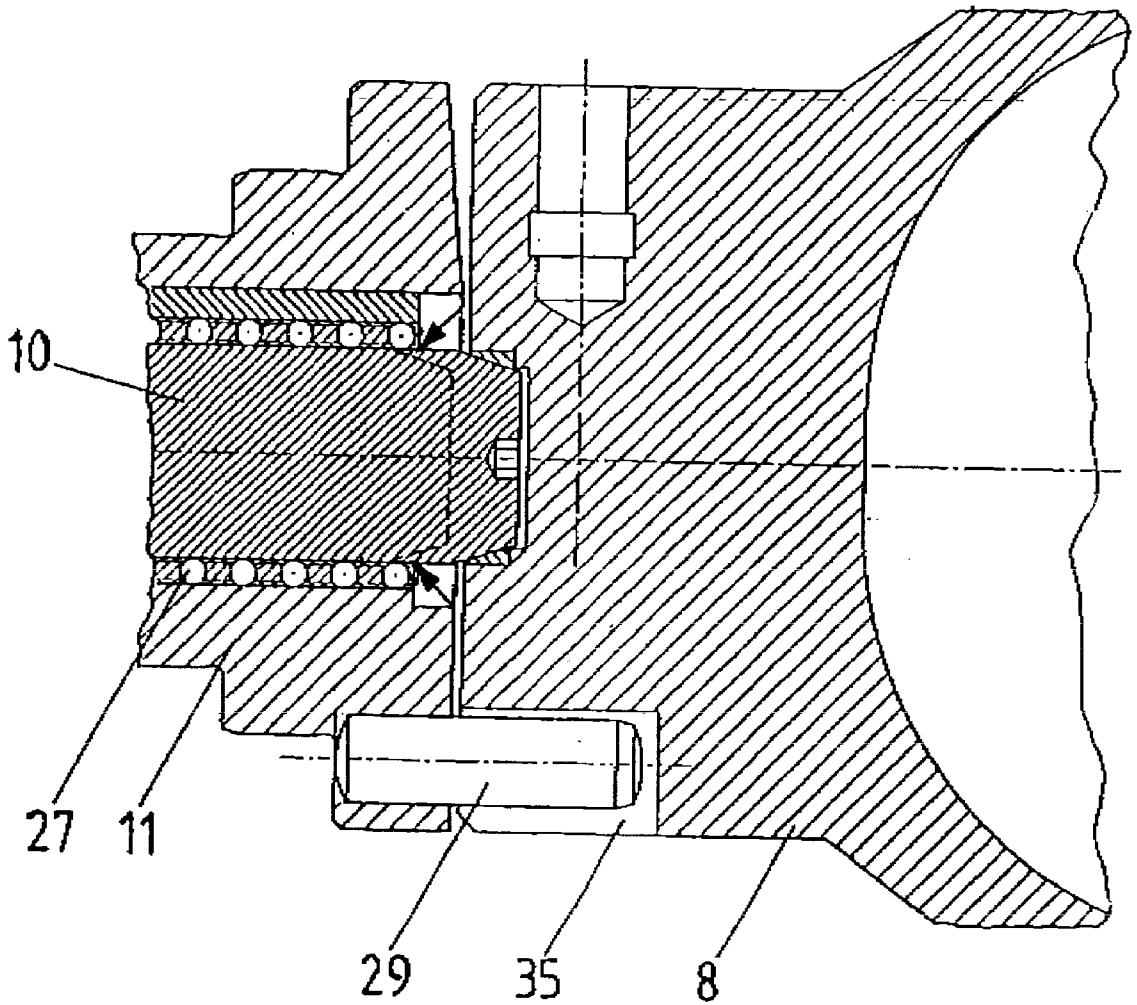
FIG. 4 is an enlarged vertical section of a bearing with axially latching of a cylinder.

In an alternative additional embodiment, the locking mechanism 29, for example, in the form of a bolt, is arranged with its axis parallel to the axle of cylinder 3 on the bearing bushing 11, and an opening 35 or a bore for the form-fit connection of locking mechanism 29 is arranged on each end 8 of the cylinder 3 (FIG. 4).

Figure 5:
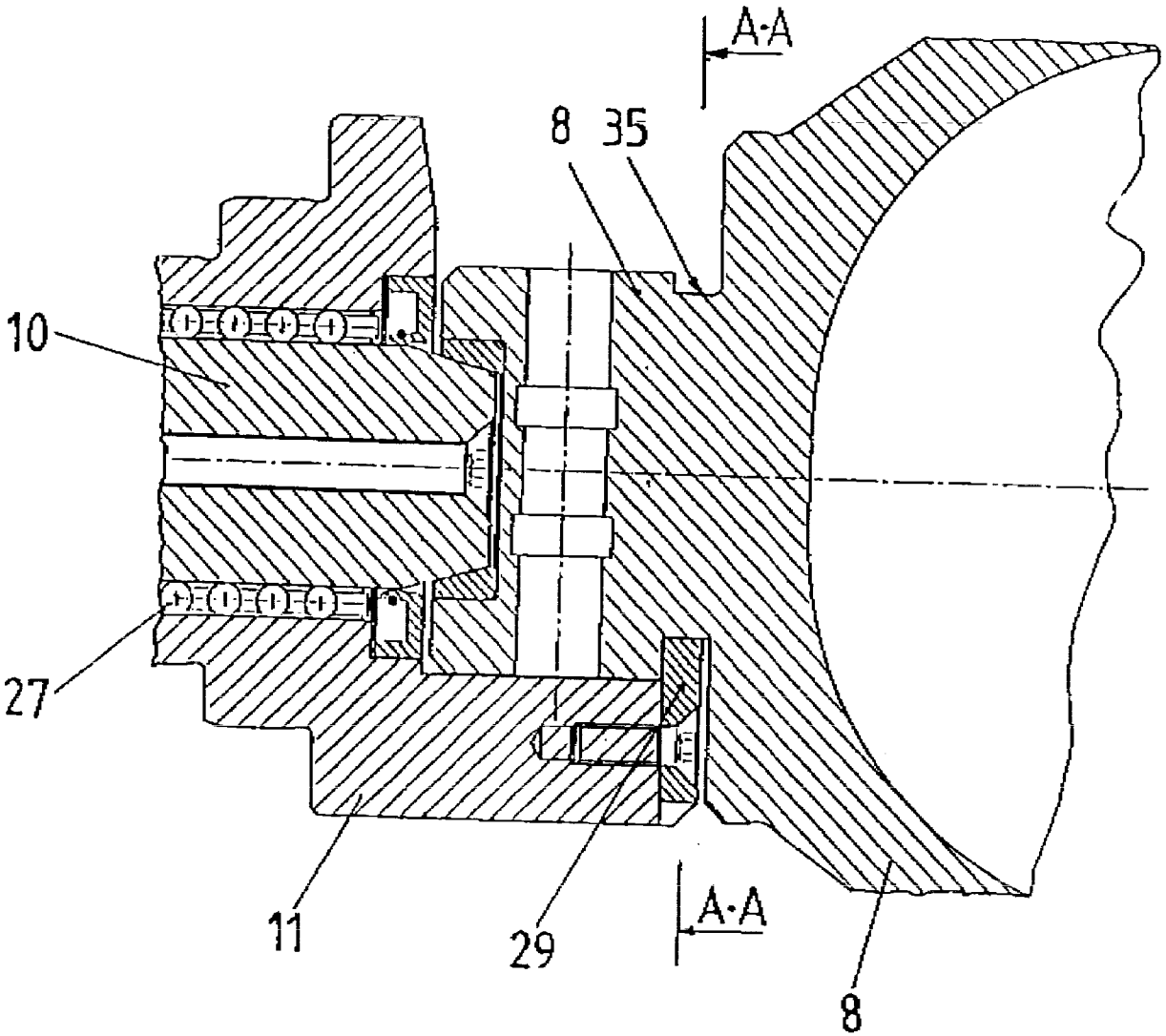
FIG. 5 is an enlarged vertical section of a bearing with circumferential latching of the cylinder.
Figure 6:
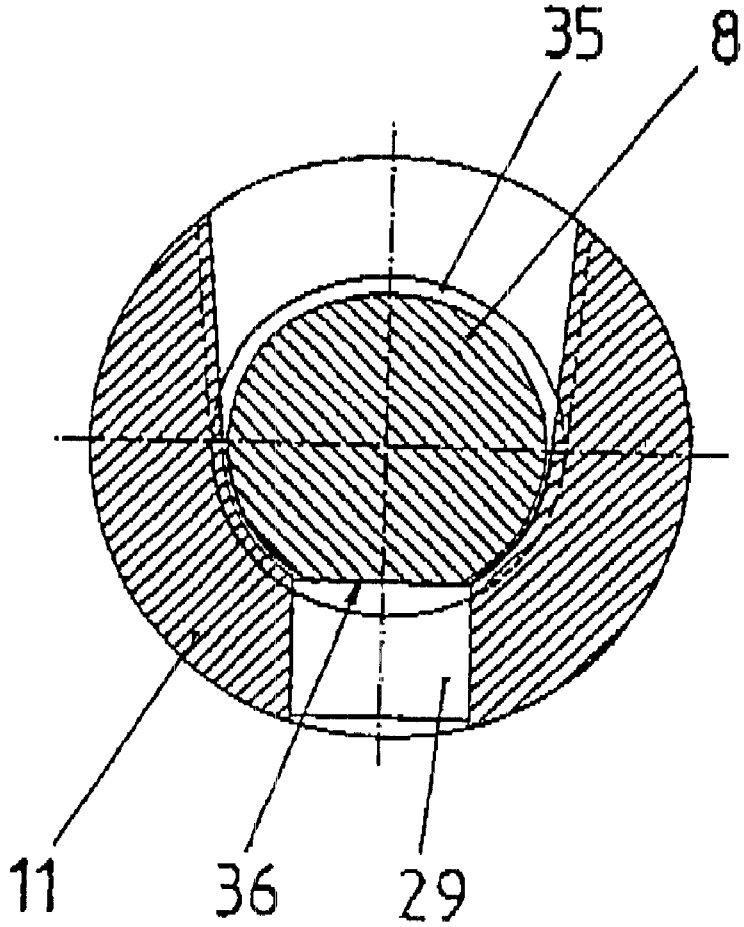
FIG. 6 is transverse section taken in the plane of line A—A in FIG. 5.

In a further alternative embodiment according to FIGS. 5 and 6, the locking mechanism 29 is arranged circumferentially on the bearing bushing 11 and, on each end 8 of the cylinder 3, an opening 35, for example, with threads or preferably in the form of a groove for the form-fit of the locking mechanism 29, is arranged. It is preferred that the half-shell bearing of the bearing bushing 11 in this case be approximately U-shaped, and includes a plate as locking mechanism 29. The plate, as locking mechanism 29, engages in the opening 35, which is designed as a circumferential groove at the opening 35 on the end 8. Here the circumferential groove in the opening 35 presents a secant-shaped abutment surface 36 which represents a circumferential form-fit connection with the plate shaped locking mechanism 29.

According to FIG. 3, in the lateral machine frame 21 of the other side, for example the B side—similar to the A side—a bearing 28 is arranged, preferably, a commercially available eccentric bearing. A bearing bushing 11 is located in the bearing 28 and receives the end 8 of the cylinder 3, and a rod 31, which aligned with the axis of the cylinder 3, passes through the center, inside the bearing bushing 11. In the direction toward the end of the cylinder 3, the rod 31 supports, at one end, a concentrically arranged spindle sleeve 10 and, on the other end, a brake disk 25 is arranged on the rod 31. The spindle sleeve 10 is arranged in a linear guide 27 in the bearing bushing 11 and is designed, in the direction toward the end 8, in the form of a cylinder, cone or truncated cone. The design of the spindle sleeve 10, in the form of a cylinder or cone/truncated cone, is formed so that cooperates with the centering portion 9 in the end 8 of the cylinder 3. In the bearing bushing 11, between the bushing and the spindle sleeve 10, and preferably concentrically with respect to the rod 31, a tensioning system 26, for example, a spring system, is arranged. The brake disk 25, which is arranged at the end of the rod 31, is again a part of a brake system, which includes a holder plate 24 and at least one, preferably several, actuation devices 23, for example, the working cylinder that can be actuated pneumatically or hydraulically. The holder plate 24 functions as a brake shoe and simultaneously carries the actuation devices 23 which are supported on the lateral machine frame 21.

If the bearing 28 is designed as an eccentric bearing, then the actuation devices 23 are arranged on the bearing 28 to guarantee the pivoting motion of the eccentric bearing. The bearing bushing 11 is analogous to the bearing bushing on the A side (FIGS. 2, 4, 5, 6) and its above-mentioned variants which are designed with a locking mechanism 29 for the form-fit connection with the end 8 of cylinder 3.

In the area of the brake disk 25 on the end of rod 31, second drive 30 is provided as an auxiliary drive, which is coupled to a gear 33, for example, a worm gear. The gear wheels 30 and 33 are preferably designed as a worm drive, where the auxiliary drive 30, in the case of a bearing 28 which is designed as an eccentric bearing, is arranged on the latter so that it can be pivoted. The gear 33 is connected to a hollow shaft 32, which is located in the drive 30, and through which the rod 31 passes. The hollow shaft 32 includes a freewheel, which is arranged on the inside at the bearing bushing 11.

It will be seen that the work procedure may be as follows: cylinder 3 and bearing bushing 11 are decoupled.

Before insertion of the cylinder 3, the actuation devices 23 are actuated, where the actuation devices are preferably coupled by appropriate circuitry to a central control; the bearing bushings 11 are stopped (braked until they stop moving) by means of the brake system 23, 24, 25, preferably with frictional connection. For this purpose, the holder plate 24 is moved by the actuation device 23 axially in the brake position ($1^{st}$ pass section). When the desired position of the bearing bushings 11 has been reached, as determined by means of a sensor or, for example, a contact cam, the actuation device 23 continues to be actuated so that the holder plate 24 can be moved by the actuation devices 23 axially in a position for decoupling ($2^{nd}$ pass section). In this process, the holder plate 24 axially moves the brake disk 25 and the rod 31 with the spindle sleeve 10 in such a way that the holding strength of the tensioning system 26 is overcome, and the spindle sleeve 10 is moved out of the centering portion 9. In the case of the design of the bearing bushing 11 as a half-shell bearing with locking mechanism 29, during the coupling/decoupling, the bearing bushing 11 is moved, under sensor control, by the drive 30 into a position in which the cylinder 3 is applied on the half-shell bearing of the bearing bushing 11, and the locking mechanism 29 engages the form-fit connection with respect to the end 8.

Cylinder 3 is inserted between the lateral frames 21. The actuation devices 23 release the brake disk 25, and the spindle sleeves 10, which are mutually aligned and subjected to a force from the tensioning system 26 and moved axially in the centering line 9 of the front sides 8. As a result, tension is applied to the cylinder 3, and it is centered. Alternately, one can use, instead of the tensioning system 26 with spring force, an actuation device which can be actuated hydraulically or pneumatically, or a threaded drive, in order to generate an axially acting force.

To transfer the moments of inertia, the latches 29, as a function of their design (FIGS. 2–6), have form-fit connections with the ends 8 so that they can also be disconnected. The position for coupling or decoupling cylinder 3 with the latches 29 is preferably controlled via the drive 30 which is preferably coupled by circuitry to a central control and actuated by a contact cam or by sensing means for positioning.

What is claimed is:

1. A printing machine comprising at least one cylinder (3) rotatably supported by bearing supports at opposite lateral sides, a coupling device for coupling and decoupling said cylinder from a main machine drive and said bearing supports, said bearing support on at least one lateral side of said cylinder (3) including a fixed bearing (28), a bearing bushing (11) supported within said fixed bearing (28) for relative rotation and being coupled to at least one drive (22, 30), a spindle sleeve (10) disposed within said bearing bushing (11), a linear guide (27) supporting said spindle sleeve (10) within said bearing bushing for relative linear movement, said cylinder (3) having a centering portion (9) for the centered reception of an end of said spindle sleeve (10), said spindle sleeve (10) having a rod (31), a selectively actuatable brake system (23, 24, 25) which includes a brake disk (25) mounted on said spindle sleeve rod (31), a force system (26) between said bearing bushing (11) and said spindle sleeve (10), and said bearing bushing (11) having a lock (29) for connection to an end (8) of said cylinder (3).

2. A printing machine of claim 1 in which said fixed bearing (28) is an eccentric bearing.

3. The printing machine of claim 1 in which said at least one drive includes a gear of a gear train of said main drive.

4. The printing machine of claim 1 in which said at least one drive includes an auxiliary drive (30) coupled to a flywheel.

5. The printing machine of claim 1 in which said centering portion (9) of said cylinder (3) is in the form of a cone.

6. The printing machine of claim 1 in which the centering portion of the cylinder (3) is cylindrically configured.

7. The printing machine of claim 5 in which said spindle sleeve (10) has an end in the form of a cone that matches the centering portion (9) of the cylinder (3).

8. The printing machine of claim 6 in which the spindle sleeve (10) has a cylindrically configured end that matches the shape of the centering portion (9) of the cylinder (3).

9. The printing machine of claim 1 in which said force system urges said spindle sleeve in a direction to actuate said braking system (23, 24, 25), an actuator for moving said spindle sleeve (10) and rod (31) into position for engaging said braking system and permitting removal of said cylinder centering portion (9) from said spindle sleeve (10), and upon deactuation of said braking system said spindle sleeve (10) being moved under the force of said force system (26) into engagement with the centering portion (9) of said cylinder (2).

10. A method for coupling and decoupling a cylinder in a printing machine from a main drive and lateral bearings at opposite ends of the cylinder in which at least one end of the cylinder has a centering portion and at least one of the lateral bearings includes a bearing bushing having an axial force loaded spindle sleeve comprising the steps of stopping the main drive of the printing machine, operating an auxiliary drive to move the spindle sleeve against the axial force loading for enagaging a braking system to stop the spindle sleeve and to decouple the spindle sleeve from the centering portion of the cylinder, and recoupling the cylinder to the main drive and lateral bearings by disengaging the braking system and axially moving the spindle sleeve by its axial force loading into the centering portion of the cylinder.

* * * * *